US005645515A

United States Patent [19]

Armstrong et al.

[11] Patent Number: 5,645,515

[45] Date of Patent: Jul. 8, 1997

[54] STILT SYSTEM

[76] Inventors: William D. Armstrong, 516 53rd St., Galveston, Tex. 77551; Joe Lin, 4114 Kingcotton La., Missouri City, Tex. 77459

[21] Appl. No.: 504,378

[22] Filed: Jul. 19, 1995

[51] Int. Cl.[6] ..... A63B 25/02

[52] U.S. Cl. ..... 482/75; 482/76

[58] Field of Search ..... 482/75, 76

[56] References Cited

U.S. PATENT DOCUMENTS 3,102,272 9/1963 Emmert .
3,902,199 9/1975 Emmert .

*Primary Examiner*—Lynne A. Reichard

[57] ABSTRACT

An improved spring-loaded parallelogram stilt. An improved leg support attachment is provided in which the leg support is attached by a capturing bracket to the rearward vertical support. A nut and bolt pass through the capturing bracket, the bottom of the leg support and through a plastic block captured within the inside of the hollow tubular vertical leg support. A yoke structure is provided at the shoe platform level for providing further connection and adjustable support for the leg support. The yoke structure is of two pieces which surround the tubular leg support and has an inner surface made of a resilient material. The yoke structure is slidably engaged with a slot in a bracket attached to the outside of the shoe platform. The lower leg support attachment employing the capturing bracket and the yoke structure serve to prevent the leg support from accidentally becoming detached from the stilt. Improved straps are also provided, made of a suitable belt or strap material and have on the surface of the straps or belts hook and loop fastening material. The hook and loop fastening material is arranged on the surface of the straps such that multiple folds of the material create a firm, yet readily adjusted and released, attachment of the straps. This is achieved by having one flap of the strap having loop fastening material on both sides. The remaining surfaces of the strap are covered with hook fastening material. A gap or space is provided between the different fastening material patches so that fold lines are created in which a fastening buckle is engaged. The length of the strap is adjusted using an adjustment buckle.

4 Claims, 3 Drawing Sheets

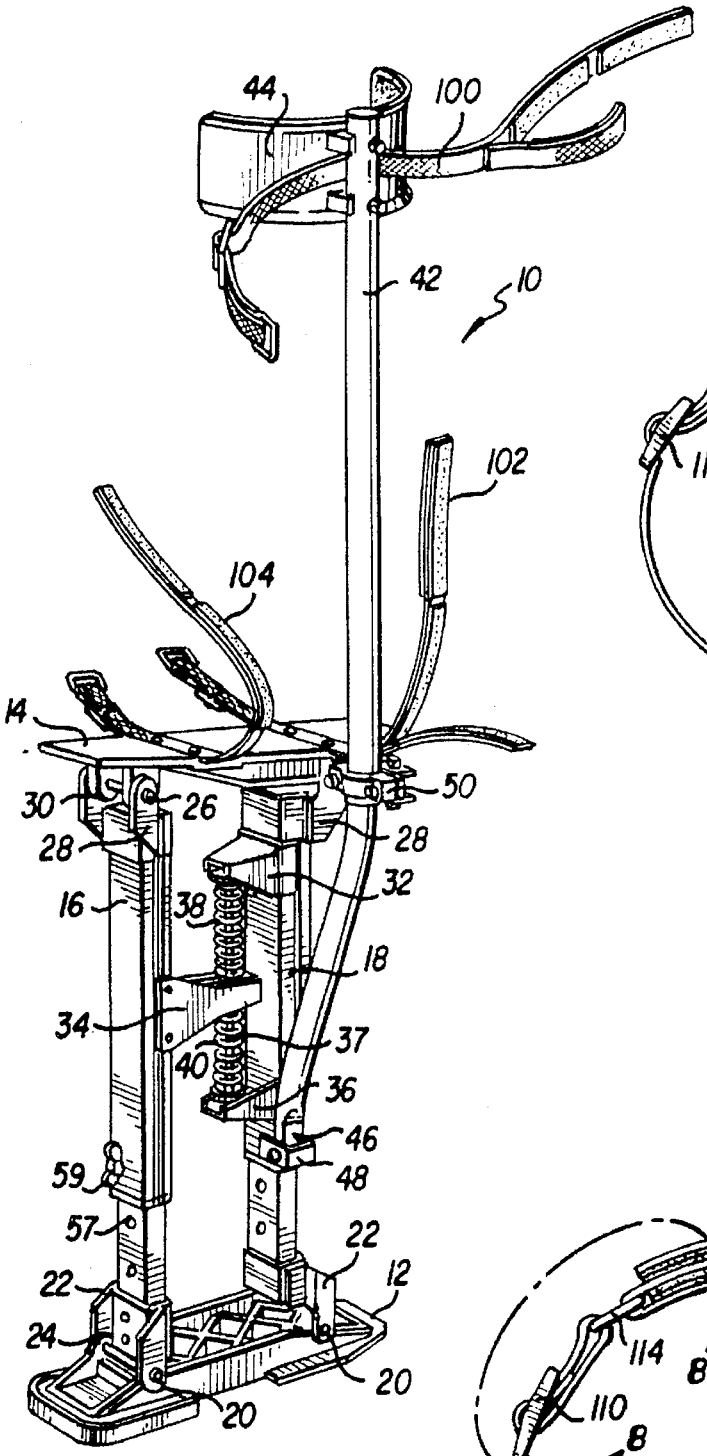
FIG. 1
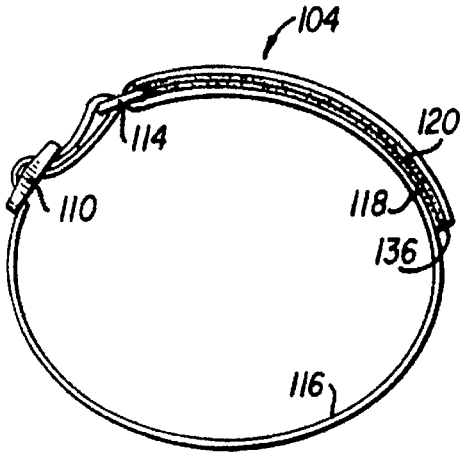
FIG. 7
FIG. 6
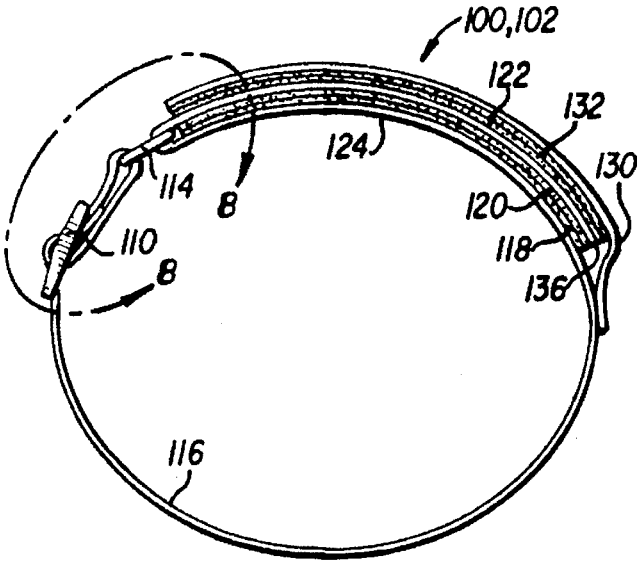

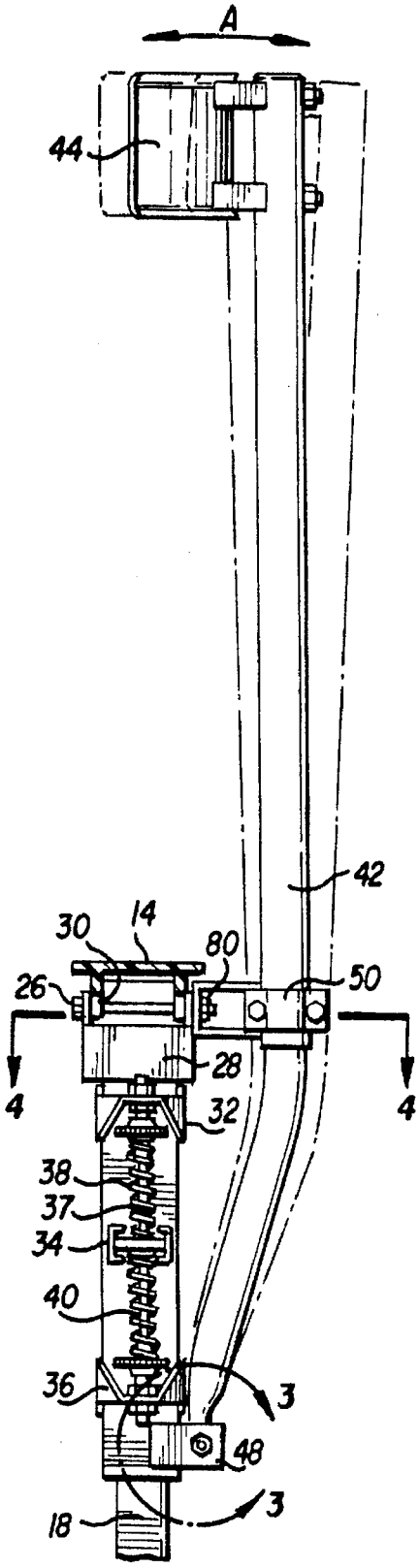
FIG. 2
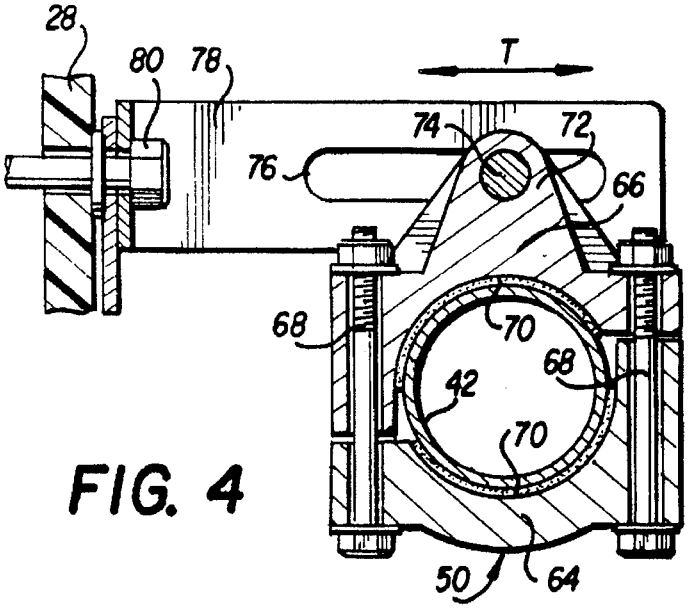
FIG. 4
FIG. 3
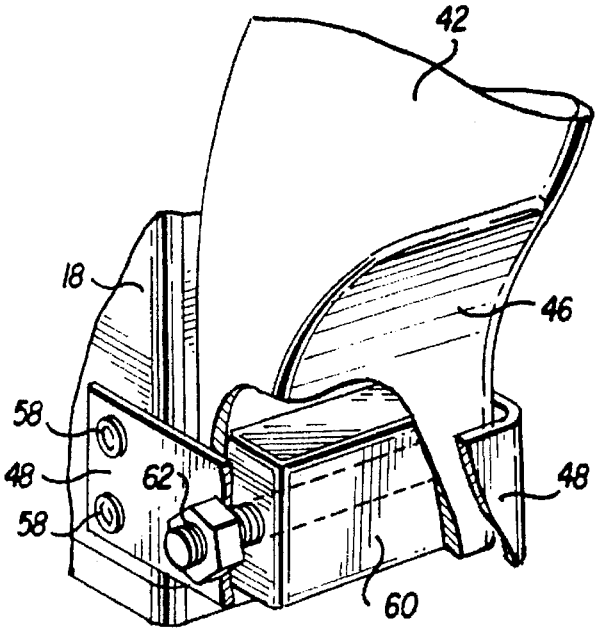

STILT SYSTEM

FIELD OF THE INVENTION

The present invention relates to stilt systems, particularly stilt systems used in the construction industry for accessing and hanging suspended ceiling structures, as well as accessing electrical and heating, ventilation and air conditioning duct work in such suspended ceilings.

BACKGROUND OF THE INVENTION

In order to attach fasteners, suspend a ceiling or access suspended ceiling structures and the related electrical heating, ventilation and air conditioning structures which are provided therein, construction workers and other skilled craftsmen frequently use stilt systems. Such systems permit them freedom of movement by walking, while raising the workers to a desired elevated height. Such stilts are known in the art and are sold under various trade names. One well-known stilt system is sold under the trade name DURA-STILT and is described in U.S. Pat. Nos. 3,102,272 and 3,902,199, the disclosures of which are hereby incorporated by reference herein. The DURA-STILT is an adjustable stilt to be worn on each leg. It has a floor platform and a shoe platform which are connected by two parallel spring-loaded pivotally mounted vertical members. A hollow tubular leg support is attached to the rearward vertical member. Straps are provided for attaching the leg support to the user's leg and for attaching the ankle area and the toe area of the shoe to the shoe platform. Because the vertical members are pivotally attached to the upper shoe platform and the lower floor platform and are spring-loaded, the vertical members are maintained in a substantially parallelogram configuration. This permits the user to walk readily on the stilts and maintain his balance.

The prior art stilt systems had several disadvantages. The straps which attach the user's legs and shoes to the stilts were bulky and not readily fastened, unfastened and adjusted. In addition, and more importantly, the leg support member had a tendency to loosen and become detached from the stilt, thereby causing the stilt to disassemble and the user to fall.

The present invention is directed to overcoming the disadvantages of the prior art stilt systems.

SUMMARY OF THE INVENTION

The present invention is directed to improvements in the spring-loaded parallelogram stilt of the DURA-STILT type. An improved leg support attachment is provided in which the leg support is attached by a capturing bracket to the rearward vertical support. A nut and bolt pass through the capturing bracket, the bottom of the leg support and through a plastic block captured within the inside of the hollow tubular vertical leg support. A yoke structure is provided at the shoe platform level for providing further connection and adjustable support for the leg support. The yoke structure is of two pieces which surround the tubular leg support and has an inner surface made of a resilient material. The yoke structure is slidably engaged with a slot in a bracket attached to the outside of the shoe platform. The lower leg support attachment employing the capturing bracket and the yoke structure serve to prevent the leg support from accidentally becoming detached from the stilt.

Improved straps are also provided. These straps are made of a suitable belt or strap material and have on the surface of the straps or belts hook and loop fastening material such as VELCRO® brand fastening material. The hook and loop fastening material is arranged on the surface of the straps such that multiple folds of the material create a firm, yet readily adjusted and released, attachment of the straps. This is achieved by having one flap of the strap having loop fastening material on both sides. The remaining surfaces of the strap are covered with hook fastening material. A gap or space is provided between the different fastening material patches so that fold lines are created in which a fastening buckle is engaged. The length of the strap is adjusted using an adjustment buckle. The advantages of the present invention are shown in the drawings and the detailed description which follows.

BRIEF DESCRIPTION OF THE DRAWINGS

FIG. 1 is a perspective view of an improved stilt in accordance with the present invention;

FIG. 2 is a detail elevational view of a leg support portion of the improved stilt in accordance with the present invention;

FIG. 3 is a partially fragmented detail view of the lower attachment of the leg support to the stilt;

FIG. 4 is a detail view of an adjustable yoke attachment of the leg support at a shoe platform level;

FIG. 6 is a side view of a leg or ankle strap in engaged configuration;

FIG. 7 is a side view of a toe strap in engaged configuration; and

DETAILED DESCRIPTION OF THE DRAWINGS

Figure 5A:
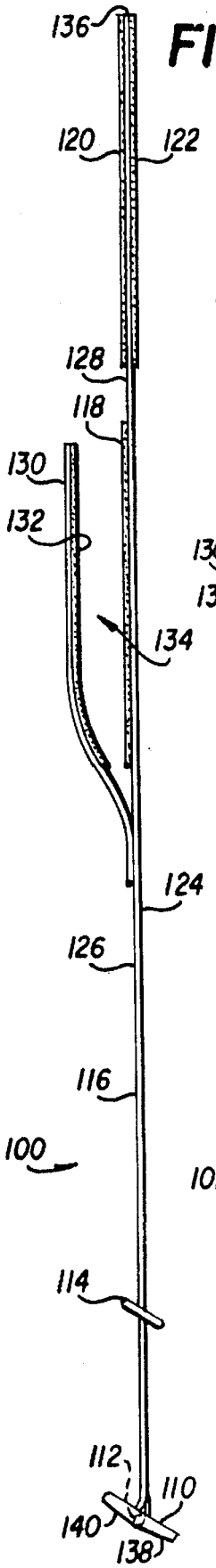
FIG. 5A–5C are side views of improved straps in a laid-open state prior to the ends being threaded through the adjustment buckle for adjustment and cinching.
Figure 5B:
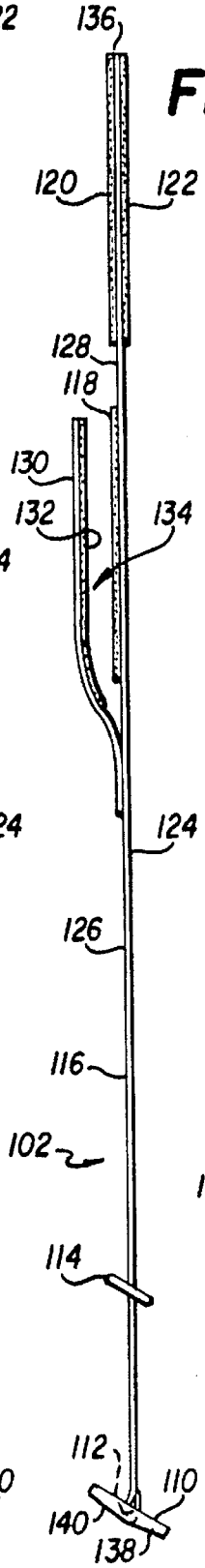
Figure 5C:
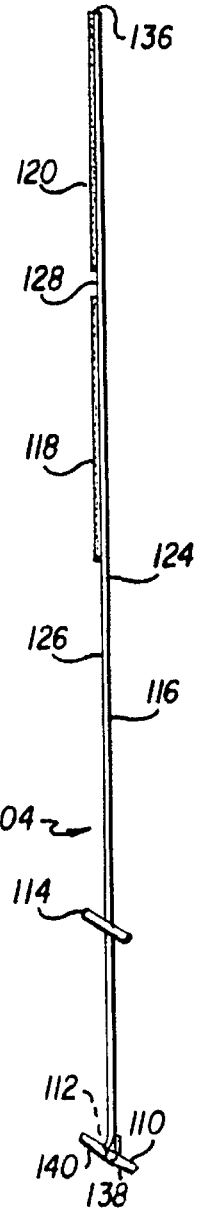

Referring now to the drawings, wherein like elements are denominated by like numerals, FIG. 1 shows an improved stilt, generally designated by the numeral 10, in accordance with the present invention. The stilt 10 is of an adjustable parallelogram type known in the art and sold under the trade name DURA-STILT. The stilt is comprised of a floor platform 12, a shoe platform 14, forward vertical support member 16 and rearward vertical support member 18. Forward vertical support member 16 is pivotally attached to floor platform 12 by a pin or bolt 20 fastened through bracket 22 and brushing 24. A similar arrangement of pin or bolt 26, bracket 28 and bushing 30 is provided to attach forward vertical support member 16 to shoe platform 14. Corresponding attachments are provided to attach rearward vertical support member 18 to floor platform 12 and shoe platform 14. Spring supports 32, 34 and 36 and centering rod 37 (FIG. 2) capture springs 38, 40, which provide spring biasing of the two vertical support members 16, 18. Hollow tubular leg support 42 having calf brace 44 is attached at its lower end 46 to rearward vertical support 18 by capturing bracket 48. Leg support 42 is attached to shoe platform 14 by yoke 50. Calf strap 100 is attached to calf brace 44. Ankle strap 102 is attached to the rear of shoe platform 14. Toe strap 104 is attached at the front of shoe platform 14. The straps are attached by suitable fasteners such as rivets or nuts and bolts.

Vertical support members 16, 18 are each telescoping and have adjustment holes 57 which are engaged by wing nut bolts 59, thereby permitting the vertical support members 16, 18 to be vertically adjusted.

FIGS. 2–4 provide further details of the attachment of leg support 42 to stilt 10. Capturing bracket 48 is attached below the biasing spring assembly to rearward vertical support 18 by rivets or bolts 58. Leg support lower end 46 is shaped or contoured as shown (FIG. 3) so as to fit within capturing bracket 48. A bolt support block 60, preferably made of plastic, is fitted within leg support lower end 46. Nut and bolt assembly 62 passes through capturing bracket 48, leg support lower end 46 and bolt support block 60. In the event that nut and bolt assembly 62 should come loose or break, capturing bracket 48 will still hold leg support lower end 46 in place. As shown in FIG. 4, yoke 50 is comprised of two adjoining pieces 64, 66 which encircle tubular leg support 42 and are joined by nut and bolt assemblies 68. The inner surface of yoke pieces 64, 66 are lined with a resilient padding material 70, such as foam rubber. Yoke piece 66 has an appendage 72 with an adjustable fastening pin or bolt 74. Adjustable fastening pin or bolt 74 engages slot 76 of yoke bracket 78 which is attached by suitable means such as bolt 80 to shoe platform 14. The resilient padding material 70 permits tightening of the yoke 50 around tubular leg support 42 without deforming or otherwise damaging leg support 42. The positioning of leg support 42 in the transverse direction T is provided by positioning and tightening yoke pin 74 in yoke bracket slot 76. This permits adjustment of the leg support 42 relative to the user's leg, as shown by arrow A (FIG. 2). The stilt system is made of suitable materials such as tubular aluminum or steel for the supports, and steel, rubber or plastic for the shoe and floor platforms.

FIGS. 5–8 show an improved interleaving strap system for the improved stilt. FIGS. 5A–5C show, respectively, a calf strap 100, an ankle strap 102 and a toe strap 104. Each of these straps has similar elements which are denominated by the same numerals. Calf strap 100 has an adjustment buckle 110, with a center spindle 112. A fastening buckle 114 is mounted on strap 100. Strap 100 is made of a strip 116 of a suitable strap or belt material such as nylon. A patch of hook material 118 and two patches 120, 122 of loop material (of hook and loop material such as VELCRO®) are provided on strip 116. Loop material 122 is mounted on the back or underside 124 of the strip 116 and loop material 120 is mounted on the from or face 126 of the strip 116. A gap or space 128 is provided between hook material patch 118 and loop material patch 120. A cover strip or flap 130 of the strip material is attached to strip 116 and has a patch of hook material 132 on the underside 134 of the strip 130. As will be seen from FIGS. 5A and 5B, the construction of the calf strap 100 and ankle strap 102 are identical, with the only difference being size. As shown in FIG. 5C, toe strap 104 differs from straps 100, 102 in that no cover strip or flap is provided. As a result, there is only one loop patch 120 for closure against hook patch 118.

The straps 100, 102, 104 are assembled to be in an adjustable fashion by feeding the end 136 (and cover strip 130 for straps 100, 102) through both eyelets 138, 140 of adjustment buckle 110, resulting in a loop forming to hold fastening buckle 114 in a desired position. The location of fastening buckle 114 can be adjusted by altering the length of strip material fed through adjustment buckle 110.

FIG. 6 shows a calf strap 100 or ankle strap 102 in assembled configuration. The fastening buckle 114 is located in a desired position relative to adjustment buckle 110. The end 136 of strip 116 is folded over fastening buckle 114 at gap 128 and the loop material 120 is engaged with the hook material 118. Cover strip 130 is then folded onto the strip 116 such that hook material 132 engages with loop material 122. Thus, the adjustable calf strap 100 encloses a calf or the adjustable ankle strap 102 encloses an ankle of a stilt user. FIG. 7 shows a similar arrangement for toe strap 104, except that only loop material patch 120 engages hook material patch 118 and there is no cover strip.

Figure 8:
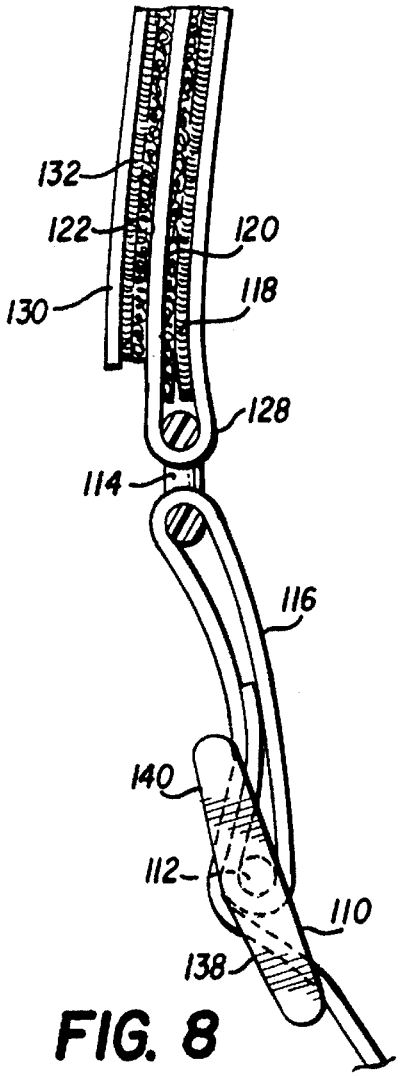
FIG. 8 is a detail view of an adjusted leg or ankle strap in buckled and engaged configuration.

FIG. 8 shows a detail of FIG. 6 of the fastening buckle 114, adjustment buckle 110 and the engagement of hook and loop materials.

In operation, the improved stilt system of the present invention works in a fashion similar to the prior art DURA-STILT. The spring-biased and pivotally mounted vertical members 16, 18 are maintained parallel and the floor platform 12 and shoe platform 14 are maintained parallel and level. Hence, a parallelogram is maintained and the user is able to walk on the stilts 10. The prior art stilts had a problem with disassembly due to the leg support 42 coming detached from the stilt 10. That situation is averted by the capture bracket 48 and leg support end 46 arrangement of the present invention. The yoke 50 arrangement of the present invention minimizes crimping or deformation of leg support 42 due to overtightening of the yoke 50, thus avoiding a problem in the prior art stilts. In addition, the improved straps 100, 102, 104 make fastening and unfastening the stilts 10 to the user's legs and feet more secure, yet readily releasable.

Although a certain presently preferred embodiment of the present invention has been specifically described herein, it will be apparent to those skilled in the art to which the invention pertains that variations and modifications of the embodiment shown and described herein may be made without departing from the spirit and scope of the invention. Accordingly, it is intended that the invention be limited only to the extent required by the appended claims and the applicable rules of law.

What is claimed is:

1. An improved stilt comprising:

a floor platform, a shoe platform, a pair of substantially vertically mounted supports pivotally connecting said floor platform and said shoe platform, said vertical supports spring-biased so as to maintain said vertical supports and said platforms in a parallelogram configuration, a leg support mounted to one of said vertically mounted supports and to said shoe platform, said mounting including a capturing bracket for engaging the lower end of said leg support and a resiliently lined yoke for engaging the leg support at the attachment to said shoe platform, said lower end and said capturing bracket engaged by a fastener so as to remain engaged despite failure of said fastener.

2. An improved stilt comprising:

a floor platform, a shoe platform, a pair of substantially vertically mounted supports pivotally connecting said floor platform and said shoe platform, said vertical supports spring-biased so as to maintain said vertical supports and said platforms in a parallelogram configuration, a leg support mounted to one of said vertically mounted supports and to said shoe platform, said mounting including a capturing bracket for engaging the lower end of said leg support and a resiliently lined yoke for engaging the leg support at the attachment to said shoe platform; and a leg support end having a reduced dimension for engaging said capturing bracket, said leg support end attached to said capturing bracket by a nut and bolt assembly passing through said bracket, said leg support end and a plastic block captured within said leg support end.

3. An improved stilt as in claim 2, further comprising a strap system including interleaving hook and loop fastener patches.

4. An improved stilt as in claim 2, wherein said strap system is comprised of a strip of material having corresponding hook and loop patches arranged to be threaded through a fastening buckle and folded so as to engage and hold said strip in place.

* * * * *